US005931691A

United States Patent [19]

Mews et al.

[11] Patent Number: 5,931,691

[45] Date of Patent: Aug. 3, 1999

[54] SOCKET FOR ELECTRICAL DEVICES, PARTICULARLY TUBULAR ELONGATED LAMPS, SUCH AS DOUBLE-BASED FLUORESCENT LAMPS AND/OR STARTERS THEREFOR

[75] Inventors: Hans-Peter Mews; Norbert Ruster, both of Lüdenscheid, Germany

[73] Assignee: Vossloh-Schwabe GmbH, Urbach, Germany

[21] Appl. No.: 08/701,198

[22] Filed: Aug. 21, 1996

Related U.S. Application Data

[63] Continuation of application No. 08/230,063, Apr. 20, 1994.

[30] Foreign Application Priority Data

Apr. 20, 1993 [DE] Germany ..... 43 12 776

[51] Int. Cl.[6] ..... H01R 4/24

[52] U.S. Cl. ..... 439/419; 439/392

[58] Field of Search ..... 439/232, 239–243, 439/438, 441, 387, 389, 393, 394, 413, 414, 418, 419

[56] References Cited

U.S. PATENT DOCUMENTS

| | | | |
|---|---|---|---|
| 3,337,837 | 8/1967 | Pistey | 439/241 |
| 3,654,587 | 4/1972 | McLaughlin | 439/241 |
| 4,807,098 | 2/1989 | Ahroni | 439/419 |
| 5,121,310 | 6/1992 | Ahroni | 439/419 |

FOREIGN PATENT DOCUMENTS

| | | |
|---|---|---|
| 1 020 113 | 11/1957 | Germany . |
| 1 137 137 | 9/1962 | Germany . |
| 1 589 272 | 4/1970 | Germany . |
| 231 4 330 C2 | 10/1973 | Germany . |
| 255 9 818 C3 | 10/1976 | Germany . |
| 32 36 868 A1 | 5/1983 | Germany . |
| 89 13 917 U | 3/1991 | Germany . |
| 464 356 | 12/1968 | Switzerland . |
| 2 114 822 | 8/1983 | United Kingdom . |

*Primary Examiner*—Hien Vu

*Attorney, Agent, or Firm*—Frishauf, Holtz, Goodman, Langer & Chick, P.C.

[57] ABSTRACT

An easily assembled socket, particularly for elongated lamps such as fluorescent lamps for use with, or without associated starters, which can be wired by automatic wiring machinery. A socket housing (2) of insulating material has reception chambers (33, 48) for receiving the blade part (57) of an slit blade insulation piercing (SBIP) connector portion (53) of a contact spring (49). The connector portion (53) extends to a connecting element portion (52) which, in turn, terminates in a contact terminal end portion (51) for engagement with a projecting terminal pin of the electrical device. The contact spring (49) is a unitary element, which can be slipped into the reception chamber (33, 48) via a lateral opening (44). Wire positioning recesses (24, 25, 34, 35) are formed in the housing leading to and from the chambers (33, 48). The blade part (57) of the connector (53) engages on the bottom wall (16) of the housing so that insertion pressure, upon insertion of a wire (W), is directly transferred to the housing structure. The housing can have a lateral extension to receive a starter, with one contact spring bent to engage the starter terminals; or a starter housing can be formed separately, supplied with SBIP connectors. If the material of the housing is flexible, it can be formed with a living hinge (103), the contact springs **(49*c*)** being inserted flat into the respective chambers and the assembly then bent about an axis transverse to the plane of the contact springs.

28 Claims, 12 Drawing Sheets

SOCKET FOR ELECTRICAL DEVICES, PARTICULARLY TUBULAR ELONGATED LAMPS, SUCH AS DOUBLE-BASED FLUORESCENT LAMPS AND/OR STARTERS THEREFOR

This application is a Continuation, of application Ser. No. 08/230,063 filed Apr. 20, 1994.

Reference to related applications, the disclosures of which are hereby incorporated by reference, assigned to the assignee of the the present application: U.S. Ser. No. 08/217,235, filed Mar. 24, 1994, KOLLER et al, now U.S. Pat. No. 5,442,848, issued: Aug. 22, 1995. U.S. Ser. No 08/226,029, filed Apr. 11, 1994, MEWS et al abandoned; U.S. Ser. No. 08/190,129, filed Feb. 3, 1994, ALBECK et al issued as U.S. Pat. No. 5,515,606, May 14, 1996.

FIELD OF THE INVENTION

The present invention relates to sockets for electrical devices, and particularly for elongated double-based fluorescent lamps, fluorescent lamp starters, combined fluorescent lamp—starter sockets, and the like, and more particularly to such sockets which are easy to make and are eminently suitable for wiring by automatic wiring apparatus.

BACKGROUND

Electrical connection between an external wiring system and contact springs adapted to be engaged by the terminals of a fluorescent lamp and/or a starter is frequently made by using terminal elements which are accessible from the outside of the socket housing through a suitable opening and which have wire clamping or similar terminals therein. The electrical connection of an insulated wire is made by introducing the connecting conductor or conductors through suitable openings into the housing after the conductor of the insulated wire has been stripped free of insulation. The contact spring is formed in the region of the opening with a flap or tongue punched therefrom to form a contact region adjacent the tongue, in which the contact region may be slightly bent to form a counter or support element for the end of the wire inserted through the opening which is clamped in that region by the free end of the tongue. The tongue is resilient. The entire arrangement can be made of a metal strip which is suitably bent generally over its flat surface to have a unitary element forming the contact spring for the pins of the lamp base as well as the contact portion and contact tongue for the electrical connection to an electrical conductor.

The starter is connected between the outer wiring by a separate clamping spring tongue located in another portion of the housing.

The referenced application U.S. Ser. No. 08/190,129, filed, Feb. 3, 1994, ALBECK et al, issued as U.S. Pat. No. 5,515,606, May 14, 1996 illustrates use of slit blade insulation piercing connectors in combination with two-pin based lamps which permit automatic wiring of a lamp fixture. Two slit blade insulation piercing connector springs are located in a housing of insulated material, placed offset with respect to each other. The slit blade insulation piercing connectors have generally U shape. The insulation-piercing slit is open on top and permits radial insertion of a conductor which still contains insulation, that is, from which an end portion of insulation has not been removed. Groove-like recesses laterally located next to the slit blade insulation piercing connector are provided to protect possibly present free, uninsulated blank ends of the conductor against accidental contact. The width of the recesses and the depth of the insertion of the conductor into the slit blade insulation piercing connector are so selected that a standardized test ball cannot touch any elements which would carry voltage with the connector in use.

THE INVENTION

It is an object to provide a socket suitable for use with slit blade insulation piercing connectors which is easily made and can readily be assembled from a complete socket for an electrical device adapted to be inserted therein, typically a fluorescent lamp, a starter therefor, or the like.

Briefly, the socket comprises a socket housing of insulating material and at least one unitary contact spring of contact element which has a contact terminal end portion adapted to be engaged by a projecting terminal of the electrical device, for example a terminal pin or a button of a fluorescent lamp, a terminal lug of a starter, or the like. The contact element further includes a slit blade insulation piercing connector, which has a conductor clamping portion formed by two blade legs of the connector adjacent the slit in the blade, located in the housing and accessible from the outside thereof. The blade is formed with a conductor insertion slit which has a width forming an interference fit with the conductor within an insulated wire. A connecting portion connects the clamping portion of the slit blade insulation piercing connector with a contact terminal portion. The socket housing is formed with a chamber which has side walls and a bottom. The chamber, thus, forms a terminal reception chamber defined, at least in part, by the chamber side walls and the chamber bottom. The chamber side walls are formed with facing insertion slots to receive the blade parts of the slit blade insulation piercing connector, the chamber bottom forming an end stop for the blade part. Recesses are formed in the socket housing between the insertion slots shaped to receive and protect the end portion of a wire inserted into the slit blade insulation piercing connector, and projecting from the conductor clamping slit of the connector blade.

Since this contact spring—slit blade insulation piercing connector is a single unitary element, any additional wiring within the socket is avoided. The slit blade insulation piercing connector portion of the unitary element, as well as the contact terminal end portion, together with the connecting element, necessary for spatial separation of the slit blade connector and the contact terminal end portion, is merely a unitary punched sheet-metal element which only need to be inserted into the housing, possibly after some bending thereof. The slit blade insulation piercing connector will be located in the externally accessible chamber which has the insertion slots therein and the recesses for the wire to be inserted. The recesses are in alignment with the insulation piercing slit of the connector.

The width of the recesses which, preferably, are groove-like, should be somewhat larger than the external diameter of the wire to be inserted in order to permit easy insertion of the conductor and to prevent any inadvertent shock hazard upon inadvertent contact with voltage-carrying elements or parts thereof. The groove-like recess is deeper than the insertion slit of the connector in order to ensure that, considering the cross section of the conductor inserted into the slit, and the required wall thickness of the insulating material, preferably a plastic material, insertion of the conductor deep into the slit of the blade connector is easy.

Introduction of the conductor into the slit blade insulation piercing connector is facilitated by forming the socket material adjacent the recess with an introduction slit above the slit blade insulation piercing connector, which narrows, in funnel-shaped form, in the direction of the slit in the connector; and by also forming the slit in the connector to be narrowing towards a bottom portion thereof. Automatic attachment in a fixture or luminaire which has the sockets in accordance with the present invention is facilitated by forming the socket housing with attachment elements thereon, unitary with the housing.

Sockets which have the features in accordance with the present invention can be shaped in various ways, for reception of fluorescent lamps for example, as well as for incandescent lamps, and of starters; it is only necessary to shape the external form and the contact terminal end portion of the contact spring according to the electrical device which is to be received. For example, to receive two-pin lamps, it is appropriate to form the housing with two generally right-angle legs, one of which having an opening for the pins of the lamp, and the other leg having chambers to receive the slit blade insulation piercing connectors.

In accordance with a preferred feature of the invention, the groove-like recesses adjacent the slit blade insulation piercing connectors are formed as two grooves, located with some space between each other, and located toward the forward side of the first leg. This makes it easily possible to insert wires with an insertion tool from the front side of the socket, so that it can pass the socket, and collision of the insertion tool with the front side of the socket is reliably avoided.

DRAWINGS

DETAILED DESCRIPTION

Figure 1:
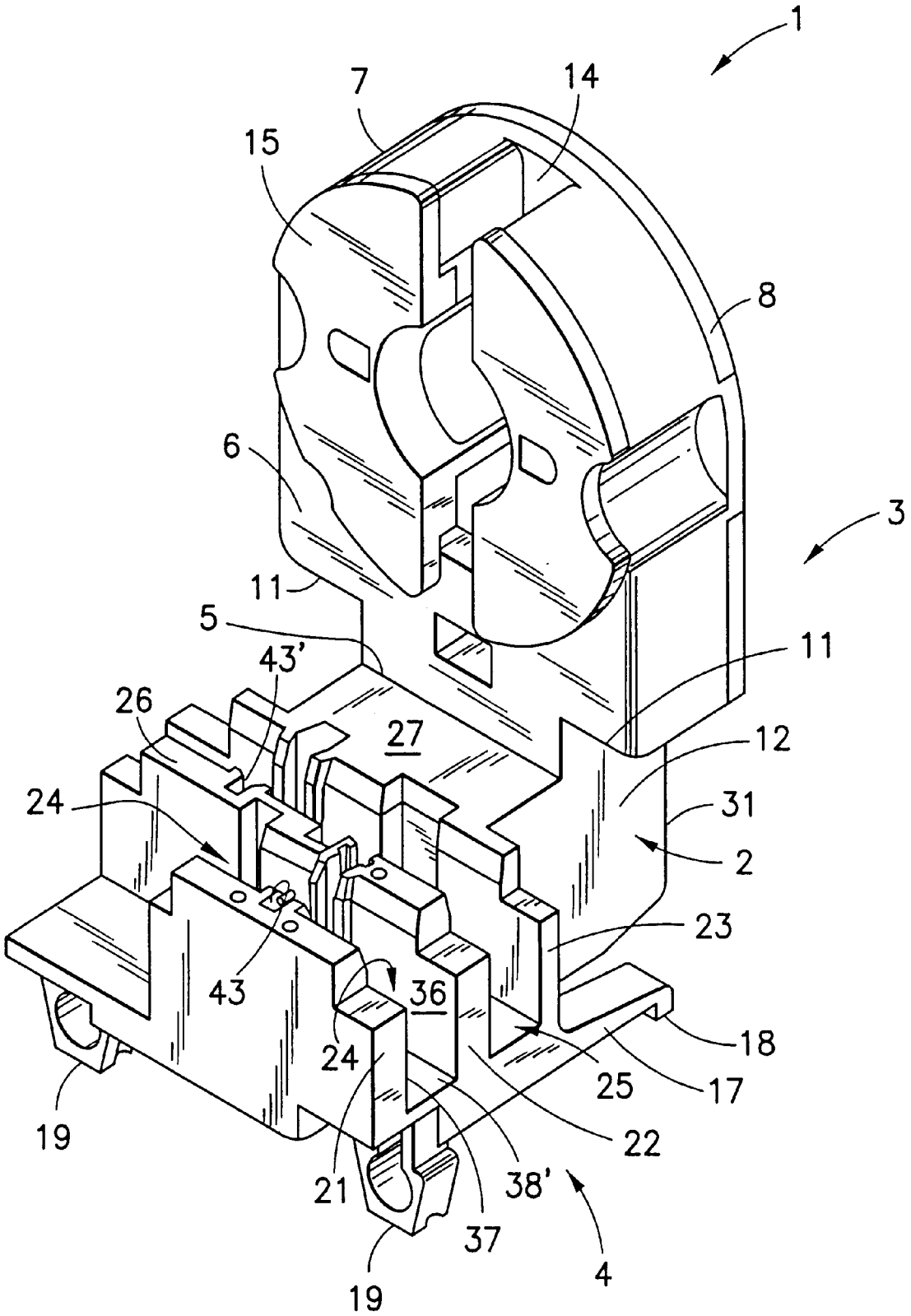
FIG. 1 is a perspective view of a socket for a double-based, two-pin fluorescent lamp.

Referring first to FIG. 1, which illustrates a socket 1 for a double-ended, double-based, double-pin fluorescent lamp, which has a housing 2 of insulating, preferably plastic material. In side view, the housing 2 is essentially L-shaped, and has an upstanding housing part or leg 3 and a laterally projecting part or leg 4. Central axes of the housing parts 3, 4 intersect at a right angle. The housing parts or legs 3, 4 are unitary and are merged together by an angle region 5. Each one of the housing portions or parts is, broadly, box-shaped.

The first housing part or portion 3 forms a forward or front wall 6 which is unitary with a curved side wall 7. The side wall 7 forms a projecting collar, which merges with the front wall 6 and which is raised towards the back side of the housing leg 3. A cover 8 is seated on the back wall. The cover 8 terminates at a lower edge 9 (FIG. 2) which is somewhat higher than the upper side of the second housing portion 4. The lower edge 9 is located approximately at a position where the first housing leg 3 is formed with two symmetrically located inwardly extending shoulders 11, which decreases the width of the housing leg 3 at that point. Two parallel side walls 12 merge with the inwardly extending shoulders 11, completing the housing part 3.

The front wall 6 is formed, as well know, with a cylindrical opening or bore 13. An elongated slot 14, extending from the top and passing through the side wall 7, passes through a rotary element 15 which, in cross section, is essentially T-shaped, and is located in bore 13. The rotary element 15 is provided in order to close off, with respect to the housing, any electrical voltage-carrying parts within the housing, when the lamp has been removed.

The second housing laterally projecting part or leg 4 has an essentially plane bottom plate 16 which is coupled at the end facing the housing part 3 with generally L-shaped side walls 12 of the housing part 3. Two branches or arms 17 project laterally from the bottom plate 16 in the direction of the first housing part 3. At their free ends they are formed with downwardly directed legs 18. Two attachment lugs 19 are located at the opposite sides of the legs 18, remote from the housing part 3 on the bottom plate 16. The feet 18 and the lugs 19 face in the same direction, that is, away from the bottom plate 16.

Three walls 21, 22, 23, relatively spaced from each other and extending parallel with respect to each other, extend from the bottom plate 16. They are parallel to planes parallel to the front wall 6. The three walls 21, 22, 23 define two adjacently located parallel grooves or recesses 24, 25. The upper edges 26 of the walls 21, 22, 23 are at essentially the same level. The upper edge 26 of wall 23 merges with a top or cover wall 27 which is unitarily formed on the front wall 6 of part 3.

The side walls 12 merge, unitarily, in the wall 23 below the top or cover wall 27 and, at the lower side, merge with the top wall 27. Two separating walls 28 which, like the walls 12 are also roughly L-shaped, are formed on the bottom side of the top wall 27, the back side of the wall 23, and the top side of the base or bottom plate 16. The rear edge of the separating wall 27 is so dimensioned that the free edge of the sidewall 7 can be flush with the rear edge 31.

Figure 3:
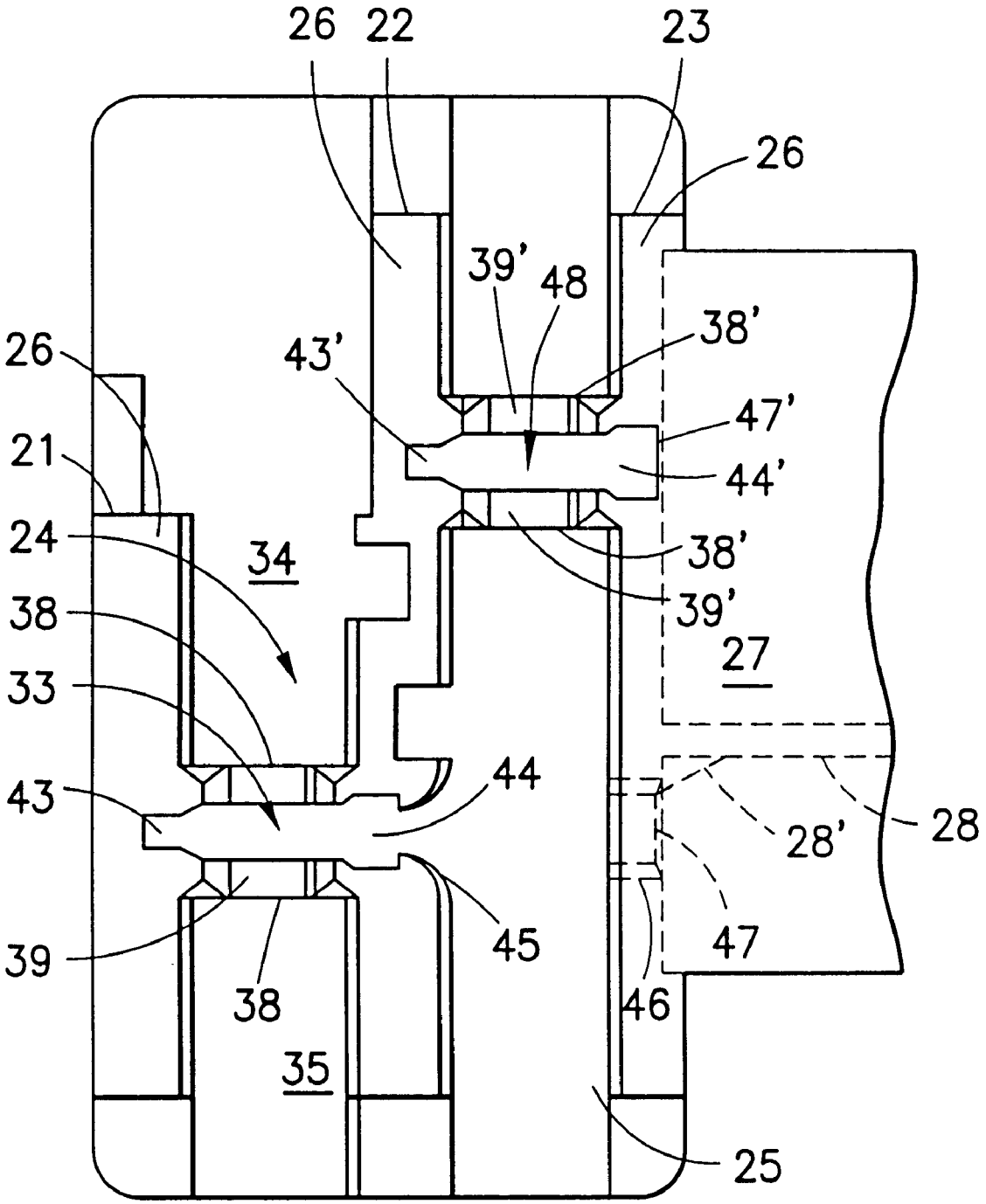
FIG. 3 is a top view of the lower leg of the housing of the socket of FIG. 1, which is partly broken away.

The wall 21 does not extend over the entire width of the base plate 16. The groove or recess 24 includes a chamber 33 (FIG. 3). The groove 24 will thus have two groove-like depression parts 34, 35, of approximately equal length separated by chamber 33. The depression parts 34, 35 are defined by two parallel, essentially straight groove walls 36, 37 (FIG. 1) and a groove bottom 38', extending at a right angle with respect thereto. The bottom 38' for example may be formed by the upper side of the base plate 16.

Figure 2:
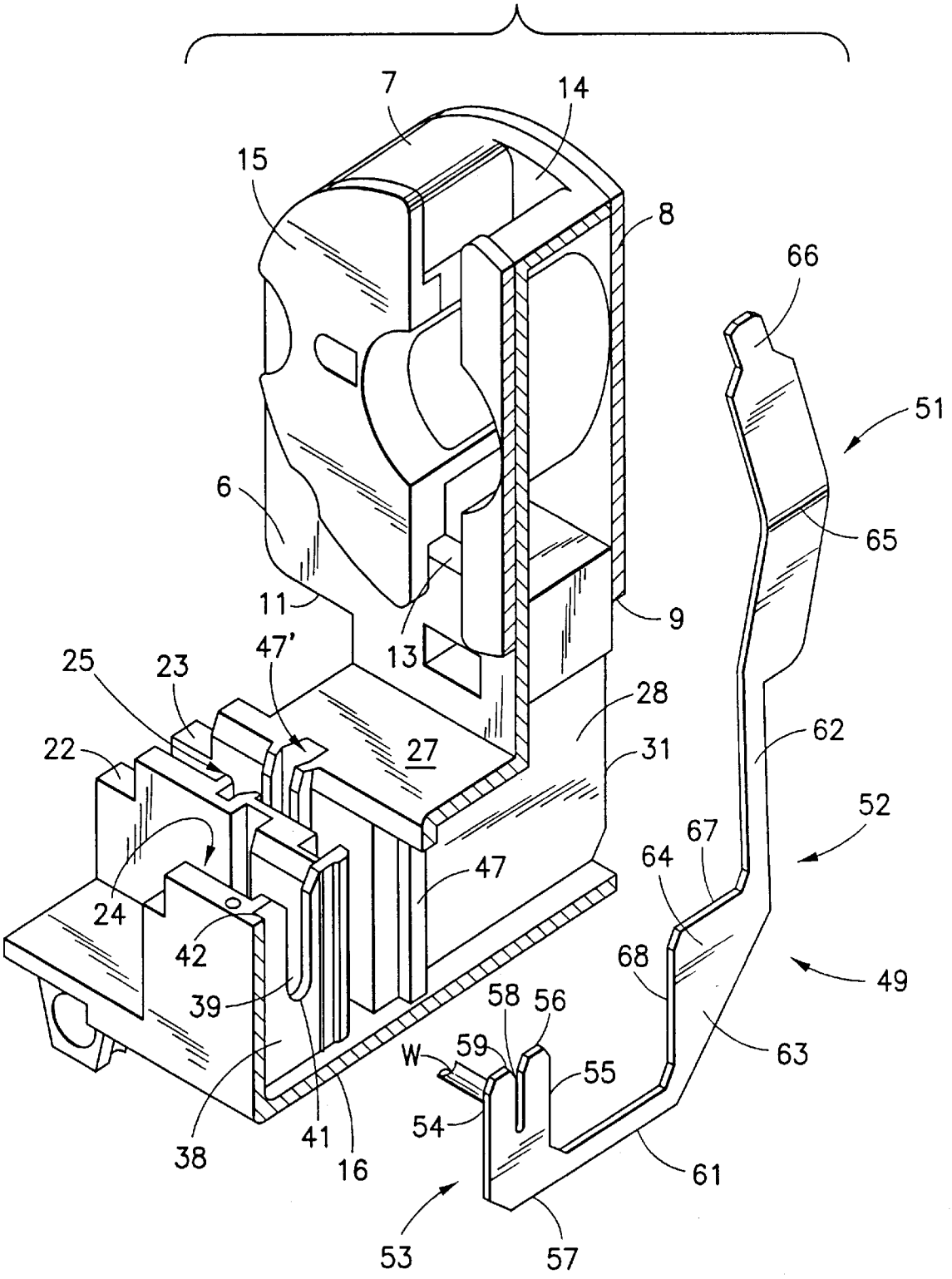
FIG. 2 shows the socket of FIG. 1, partly cut away, in part-exploded representation.

The chamber 33 is defined by two apertured, slit parallel chamber side walls 38, extending at right angle to the grooves 36, 37 and a bottom, formed by plate 16. The chamber walls 38 are mirror-symmetrical. The two walls 38, which extend from the top edge 26 to the top side of the base plate 16, of which only one is seen in FIG. 2, are formed with an aligned insertion slit 39 and located essentially in the middle of the respective groove 24. As best seen in FIG. 2, the slit 39 terminates as shown at 41 clearly above the base plate 16. The insertion slit 39 in the chamber walls 38 widens, in funnel shape, at the upward portion. As best seen in FIG. 3, the chamber 33, looked at in direction of the groove 24, is widened to the left by a chamber portion 43. The chamber portion 43 is defined by walls having parallel flanks; it extends down to the upper side of the base plate 16.

The chamber 33 is formed with a slit 44 which completely extends through the wall 22 (FIG. 3). This slit 44, extending in direction toward the groove 25, is formed with a funnel-like enlargement 45. Within the wall 22 the enlargement reaches from the upper edge 26 to the upper side of the base or bottom plate 16. The slit 44 is symmetrically positioned with respect to a plane which bisects the chamber portion 43, and is perpendicular to the base plate 16. Likewise symmetrical with respect to this plane, wall 23 is formed with an essentially rectangular opening 47, surrounded by a recess 46 of the wall 23. The width of the opening 47 corresponds essentially to the clear width of the slit 44; the height is substantially that of the walls 21, 22, 23.

At the lower end, the opening 47 merges smoothly against the top side of the base plate 16. The opening 47 is located symmetrically between a separating wall 28 (FIG. 2) and the respectively adjacent outer side wall 12 (FIG. 1). The space between the side wall 12 and the next adjacent separating wall 28 is greater than the width of the opening 47.

Small ribs 28, only one of which being shown in the drawing for simplicity, are formed on the back of the wall 23, starting from the opening 47 and extending at an inclination to the adjacent surface of the separating wall 28 and the side wall 12, respectively.

Groove 25 is formed with a chamber 48; chamber 48 is offset in longitudinal direction of the groove 25 with respect to the chamber portion 33. The chamber 48 is delimited by two chamber walls 38' which are formed in the same way as the chamber walls 38 of chamber 33; the same reference numerals, with prime notation, have been used. The chamber walls 38' are also formed, each, with an insertion slit 39', similar to slits 39, see FIG. 2.

Chamber 48 differs from chamber 33 essentially only by its position, namely that an opening 47', similar to the opening 47 in alignment with the slit 44, is positioned between a side wall 12 and a separating wall 28, neither of which is seen in FIG. 2, but at the remote side, with respect to FIG. 2. The opening 47' from which the slit 44' extends is formed directly in the wall 23. The two separating walls 28 are located between the openings 47 and 47'.

In accordance with a feature of the invention, two essentially similar contact spring arrangements or contact element 49 (FIG. 2) are located in the interior of the housing 2 of the socket 1. The contact element 49, as shown, is intended for use in the chamber 23, and has a contact spring portion 51, a connecting portion 52, and a slit blade insulation piercing connector portion 53, all in one single, unitary element.

The slit blade insulation piercing connector, for simplicity hereinafter abbreviated SBIP connector, has the form of a generally rectangular plate having a height of about 8 mm and a thickness of between about 0.3 mm to 0.5 mm. As best seen in FIG. 2, two parallel edges 54, 55 form the lateral sides of the essentially rectangular plate-like blade; end edges 56, 57 form the narrow sides thereof. An insulation piercing slit 58 extends from the upper side 56, extending inwardly of the blade essentially parallel to the edges 54, 55 in the direction of the lower edge (blade part) 57. The edge 57 is straight and parallel to the edge 56. The height of the SBIP connector, measured between the two narrow edges 56, 57, is slightly less than the height of the opening 47, FIG. 3. The lower end of the slit 58 is spaced somewhat from the lower edge 57 of the SBIP connector by a lesser spacing than the lower end 41 of the slit 39 in the upper side of the base plate 16.

To facilitate introduction of a wire W into the slit 58 of the SBIP connector, the slit 58 is enlarged, funnel-shaped, in the vicinity of the upper edge 56 by an enlargement 59.

The connecting portion 52 of the contact spring 49 connects the SBIP connector in a single, unitary element with the contact spring extension or contact spring portion 51 of the contact spring 49. The connecting portion or element 52 is generally L-shaped and has a lower leg 61, the lower edge of which smoothly merges with the lower edge 57 of the SBIP connector. It has an upper leg 62 which extends at about a right angle with respect to the leg 61. A portion 63 extends between the legs 61, 62 at an angle of about 45°, which is extended by an inwardly extending projection 64 located in the region of the 45° portion 63. The height of portion 61 is dimensioned to be clearly less than the distance from the lower end 41 of the insertion slit 39 from the upper side of the base plate 16. The intermediate element 63, except for the extension 64, is approximately of the same width as the legs 61, 62. Leg 62 extends vertically upwardly at right angle to the leg 61, and in the plane as the SBIP connector 53. The thickness and width of the respective legs is about the same.

The contact terminal portion 51, which is joined to the upper end of the leg 62, is slightly bent in its middle, as seen at the bend or crease line 65, to have a shallow V shape. Its width is matched to the length of a connecting terminal, e.g. a pin of a lamp with which the socket is to be used; with respect to the socket itself, the width corresponds approximately to the clearance space between the back side of the front wall 6 and the inside of the rearward cover 8.

The upper end of the contact terminal portion 51 terminates in an extension tab 66 which is held between suitable ribs in the housing part 3, as well known, to retain the contact terminal end portion 51 in position.

The projection 64 in the connecting part 54 defines upper and side edges 67 and 68. The dimensions of these edges must be matched to the lamp and to the housing, and can readily be determined, particularly when the assembly, as described below, is considered.

A second contact spring arrangement similar to that of contact spring 49 is provided; it is not shown in the drawing and differs from the illustrated spring 49 only in some dimensions and in the direction of the V-shaped crease of the upper part 51.

Assembly and positioning of the contact spring 49 to the socket housing 2:

The housing 2, with a back cover not assembled, is positioned so that the contact spring 49 can be pushed into the housing from the back side of the housing leg 3. The SBIP connector 53 slides with its lower edge 57 on the upper side of the base plate 16 between the inner separating wall 28, shown in FIG. 2, and the outer side wall 12, seen in FIG. 1. The contact spring 49 to be placed into the opening 47, is positioned shortly in advance of the opening 47 to fit between the ribs 28' thereof and then is pushed transversely through the groove or slot 25. The funnel-like enlargement 45 6n the slit 44 guides the SBIP connector 53 into the chamber 33. The front edge 53 engages in the narrowed chamber portion 43. In this, the final position, the front edge 68 of the extension 64 engages against the portion of the back side of the wall 23 which is above the opening 47. The front edge 54 of the SBIP connector 53, however, is spaced by a small distance from the opposite end of the chamber extension 43. At the same time, the front edge of the contact terminal end portion 51 engages against the back side of the front wall 6. The front edge of the leg 62, likewise, will engage against the back side of the front wall 6. The upper edge 67 of the projection 64 is located, with slight clearance, beneath the bottom side of the cover wall 27. The projecting tab 66, extending from the contact terminal end portion 51, is retained between suitable ribs formed in the upper leg 3 of the housing 2.

When so assembled, the leg 61 of the connecting portion 52, not insulated, extends through the groove 25. This portion 52, however, is so spaced from the upper edges 26 of the walls 22, 23 and the bottom groove 25 that any electrical contacting connection is reliably excluded; neither is insulation of any wire which is guided through the groove 25 affected by passage of the portion 61 of the contact spring 49, since the upper edge of portion 61 is substantially below the lowest region of the insertion groove or recess 39.

The second terminal spring for a two-pin lamp, not shown, is similarly assembled. The second terminal spring, to be placed into chamber 48, is essentially similar to the terminal spring 49 shown, except that the leg 61 is shorter. The length of the leg 61 is so dimensioned that when the second contact spring is inserted into the opening 47' for the second contact spring, not visible in the drawing, the SBIP connector of the second spring will locate itself in the chamber 48 as soon as the forward edge 68 of the projection 64, and the forward edge of the contact terminal end portion, respectively engage the back side of the wall 23 and the back side of the front wall 6.

Upon insertion of the respective contact springs 49, they slide with their lower edges 57 freely and unimpeded by any projections on the upper side of the base plate 16 until they reach the associated chamber 33 or 48, respectively. Both contact springs 49, when assembled, have their lower edges 57 engaged on the upper side of the base plate 16. Their end edges are flat on the upper side of the base plate. The respective conductor insertion slits 58 are located in the center of the wire insertion slits 39 of the respective chamber walls 38. The lower end of the slit 58 will disappear below the respective chamber wall 38.

After insertion of the two contact spring arrangements 49, the rotary element 15 is inserted from the front, as well known, and the back cover 8 is snapped on the assembly. This, then, reliably retains the two contact spring arrangements 49 between the front wall 6 and the rear cover 8, which prevent their removal from the housing 2.

The back cover 8 need not cover the lower part of the first leg 3 and the adjacent region of the second housing leg 4, so that a portion of the leg 62, as well as the intermediate portion 63, is open. There is, however, no danger of any accidental contact, since the side walls 12, in combination with the separating walls 28, form a reliable protection against accidental contact. The rear edges of the leg 62 or of the intermediate part 63, respectively, are recessed with respect to the rear edges 29, 31 of the separating wall 28 or the side wall 12, respectively, for such a distance that, considering the spacing between the wall 28 and the respectively adjacent side wall 12, any test ball, e.g. simulating a finger tip, for testing of accidental contact possibility cannot reach the electrically conductive contact springs 49 in the chambers between the separating walls 28 and the respective side walls 12.

The socket can be easily wired, for example with an automatic wire insertion tool in which an insulated conductor, without the ends stripped, is pushed into the respective chamber 33, 48 from above. The width of the slit 58 in the SBIP connector is matched to the diameter of the conductor within the wire W. The SBIP connector cuts the insulation which is then retained by being clamped between the edges of the insertion slits 39. The cutting and insertion force is transferred directly to the base plate 16. There are no forces which would have the tendency to remove the contact spring 49 counter the insertion path, described above, when the contact spring is mounted in the socket 1. This is obtained by placing the slit 58 in such a direction that the force upon contacting the SBIP connector with the wire extends at right angles to the assembly direction, in which the contact element 49 is inserted in the housing 2.

Figure 4:
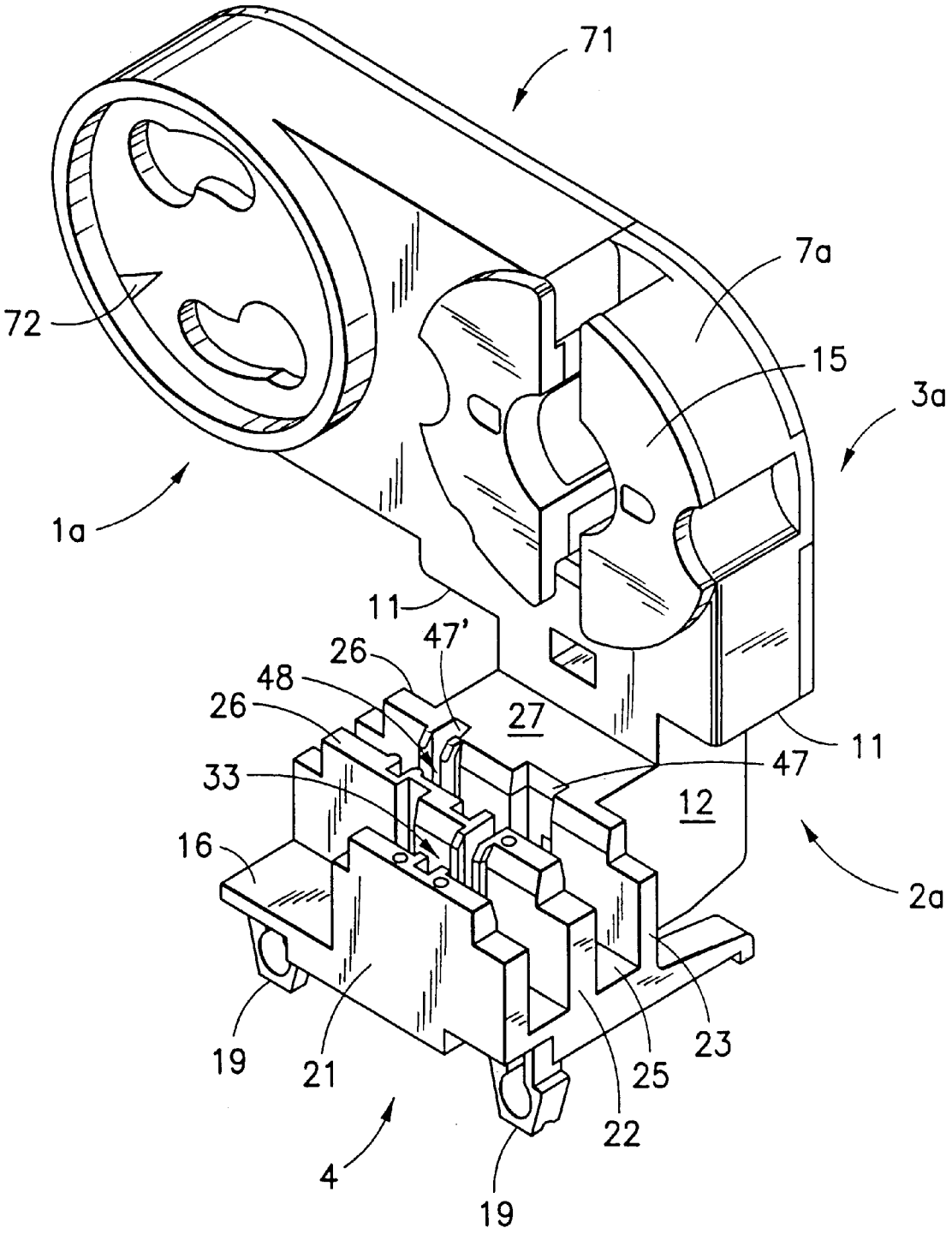
FIG. 4 is a perspective view similar to FIG. 1, with a laterally located starter socket.
Figure 5:
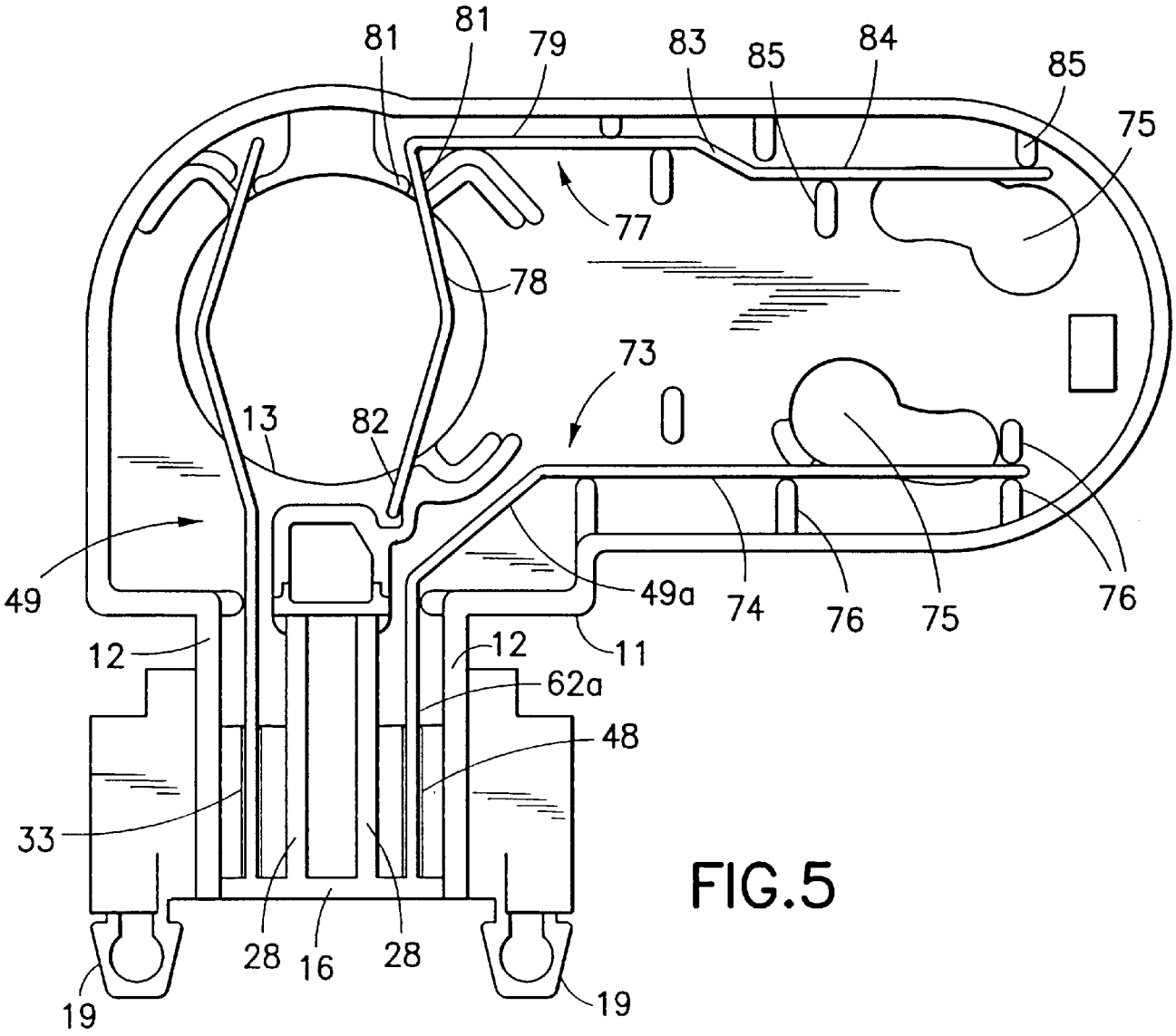
FIG. 5 is a back view of the socket of FIG. 4, with a back removed.
Figure 6:
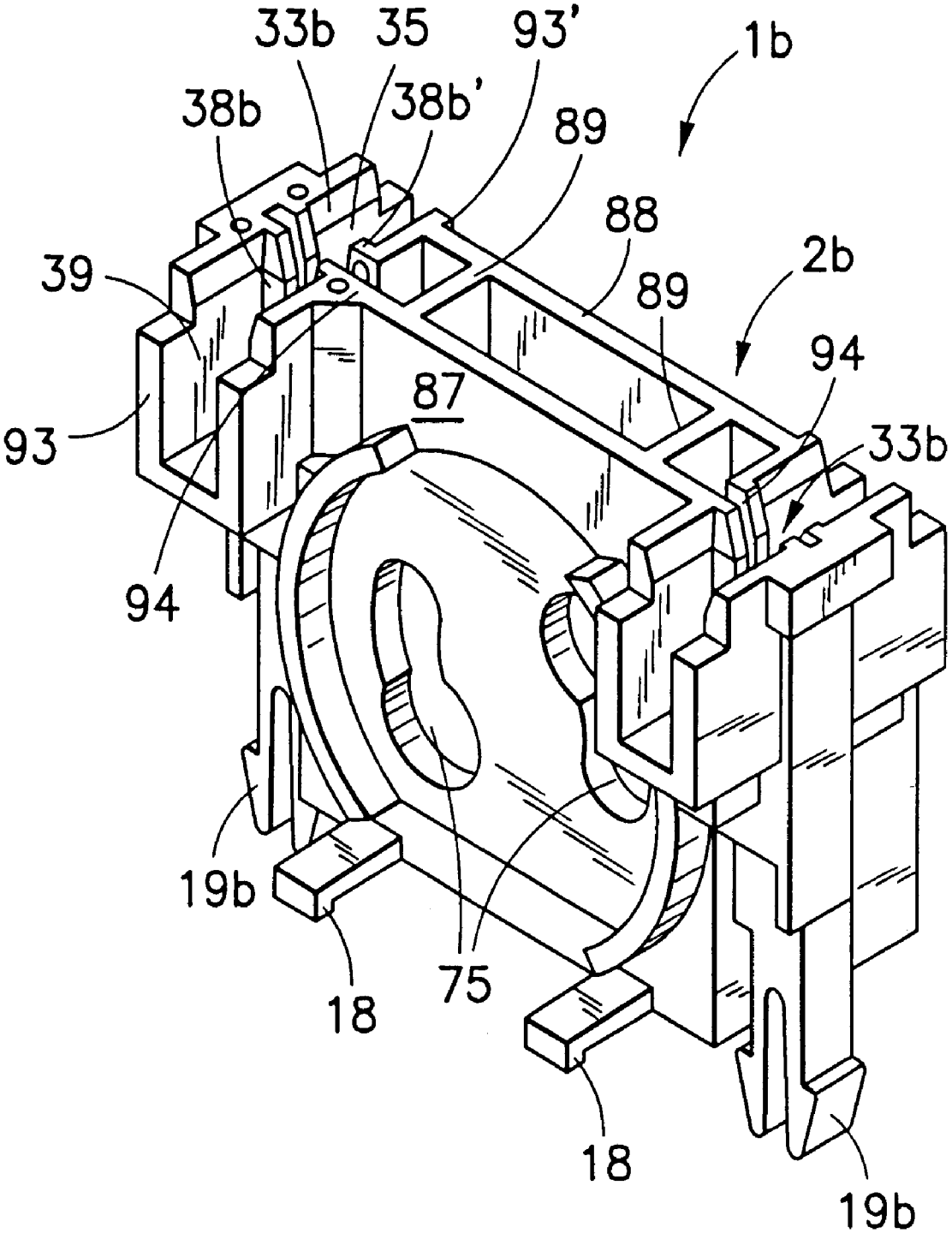
FIG. 6 is a perspective view of an individual starter socket, suitable for insertion into a lamp fixture housing.
Figure 7:
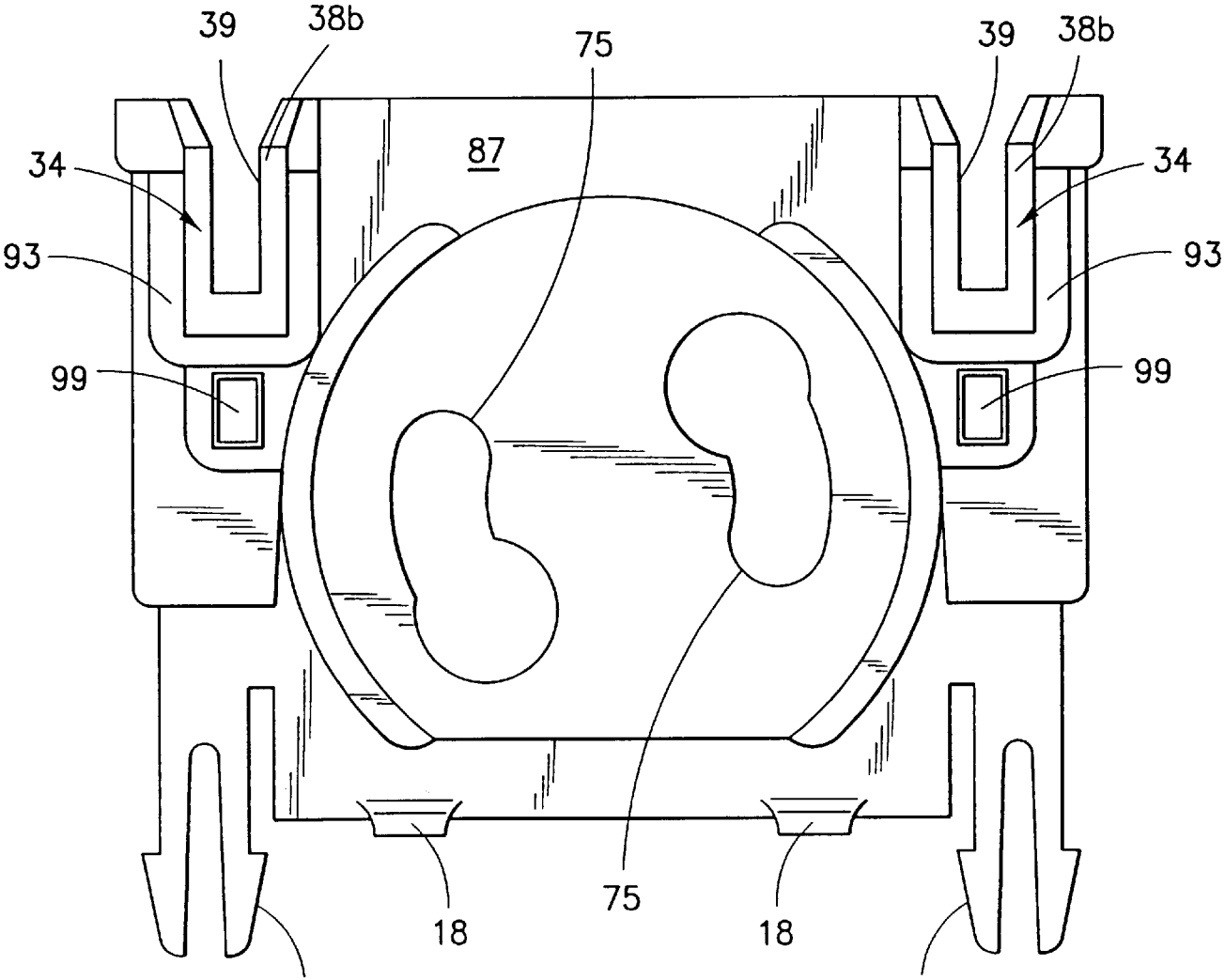
FIG. 7 is a front view of the socket of FIG. 6.

The concept of the present invention is equally applicable to sockets 1*a* which are combined with starter housings. Referring to FIGS. 4 and 5, where the same reference numerals have been used as before for similar parts; if there is some difference in shape or function, additional letter designations have been added.

The upper portion 3*a* has a lateral arm 71 on which a socket arrangement 72 for a starter is located. The second leg 4 of the housing structure 2*a* has the same shape as that described in connection with FIGS. 1–3. The leg 3*a* differs from the leg 3 of FIGS. 1–3 only in that the side wall arrangement 7*a*, to receive the starter socket 72, is laterally extended. Other than that, there is no difference. The socket of FIG. 4 has one contact spring 49, and a second contact spring 49*a*, which is shaped to also form a connection to the base pin from a starter. FIG. 5 clearly shows the overall shape of the contact spring 49*a*.

The back side has the same basic structural elements already described in connection with FIGS. 1–3. The base plate 16 for the socket portion 4 is seen, as well as the side walls 12, with the intermediately located separating walls 28, and the openings 47, 47' between a side wall 12 and an adjacent separating wall 28. The contact spring 49 is located in the opening 47'. At the right side, the contact spring arrangement 49*a* is angled off, as seen at 73, and differs from the contact spring arrangement 49 only in that the leg 62*a* is sharply bent above the angle portion 11 of the top part 3*a* of the housing, extending from the bent portion 73 in form of a straight extension or tongue 74 towards a keyhole-shaped opening 75 adapted to receive a standard starter base pin. The tongue 74 extends through the free space of the lower part of the opening 75. It is retained by position by strips 76 molded on the housing, or the housing back, respectively. The tongue 76 engages the front wall 6 from the back side thereof throughout its length.

The second electrical connection between a starter and the lamp is formed by a contact spring 77 which, similar to the terminal end portion 51 of the contact spring 49, has a portion 78 passing the bore or opening 13. Just above the opening 13, the portion 78 is angled off and then the spring forms a straight portion 79. The contact spring 77 is retained in position by suitable ribs 81 formed at the periphery of the bore 13. The spring portion 78 terminates in a pocket 82 formed by suitable ribs inside of the housing.

The straight portion 79, starting from the ribs 81, leads to an offset 83 and from there again to a straight portion 84, snugly retained in the clear space of the housing, and to the upper keyhole slot 75. Ribs 85 retain the portion 84 in position.

The lower ends of the contact springs 49, 49*a* are identical to those previously described; they are retained in the chambers 33, 48.

In some fixtures or luminaires, starters cannot be located immediately adjacent the lamp, but must be located elsewhere. FIGS. 6–9 illustrate a socket structure 1*b*, used to retain an electrical apparatus or device, for example a starter, having suitable connecting pins within a housing, for example a lighting fixture or luminaire.

The socket 1*b* of FIGS. 6, 7, 8A–8D and 9 has a unitary housing 2, which has a front wall 87 and a back wall 88. Ribs 89 and side walls 9 connect the front and back walls such that a sufficiently large space is provided between the front and back wall which is so dimensioned that when a starter or other electrical device, with its base pins, is inserted through keyhole slots 75 in the front wall 87, the free ends of the connecting pins do not engage or impinge on the inner surfaces of the rear wall 88.

Two attachment snap connectors 19*b* are unitary with the housing structure 7*b* and, together with support legs 18, are provided to attach the starter housing 2*b* in a support structure or on a support frame, for example in a suitable sheet-metal retention element, such as a portion of a luminaire.

Two slit blade insulation piercing (SBIP) connectors 58 are located in chambers 33*b*, galvanically separated from each other. The chambers 33*b* are exactly mirror-symmetrical; only one of the chambers will be described for simplicity, since the other one is, mirror-symmetrically, identical.

Chamber 33*b* has one chamber wall 38*b* which is formed by the rear surface of the front wall 87. The rear wall 38*b*' is formed by a region offset from the rear wall 88, in the direction of the forward wall 87. Two collars 93, 93' extend, respectively, from the front and rear walls 38*b*, 38*b*' of the chamber walls. The walls 93, 93', respectively, define groove-like recesses 34, 35 (FIG. 9) adjacent the respective chamber 33*b*. The collars 93, 93' form a continuous groove, separated by the chamber 33*b*, 33*b*'. Differing, however, from the prior examples, the axes of the groove-like recesses 34, 35 are perpendicular to the front wall 87.

As best seen in FIG. 8, collectively, the chamber 33 opens towards the upper side of the housing 2*b* in form of a slit 94, in the direction of the inner space between the front wall 87 and the rear wall 88. The side wall 90 continues below the slit 94, which, otherwise, closes off the interior space between the walls 87 and 88 at both sides.

The contact spring arrangements 58*b* are mirror-symmetrical for the right and left side of the socket 1*b*. They have the already previously described SBIP connector 53*b* which terminates at its lower side in an extension 95. The extension 95 has a stop flap punched out, extending upwardly to form a stop, which is provided to hold the contact spring 58*b* in the respective chamber 33*b*, once it has been pushed into the chamber.

The connecting portion 52*b* is unitarily formed adjacent the upper edge 56 of the SBIP connector 53*b* which merges with a contact terminal end portion 51*b*. This terminal end portion is a springy sheet-metal strip, having a width similar to or just slightly less than the clear distance between the inner surface of the front wall 87 and of the back wall 88. The plane of the spring 51*b* is perpendicular with respect to a plane defined by the SBIP connector 53*b*. As seen in the top view, FIG. 8C, in the direction of the arrow A, it is bent L-shaped from the plane of the SBIP connector 53*b*.

Figure 8D:
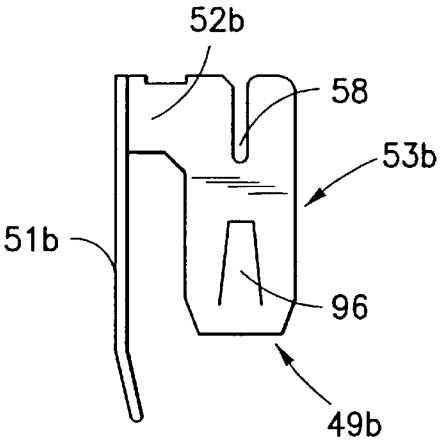
FIG. 8D is a plan view of the contact terminal adapted for insertion in the right chamber of the socket of FIG. 8A.
Figure 8A:
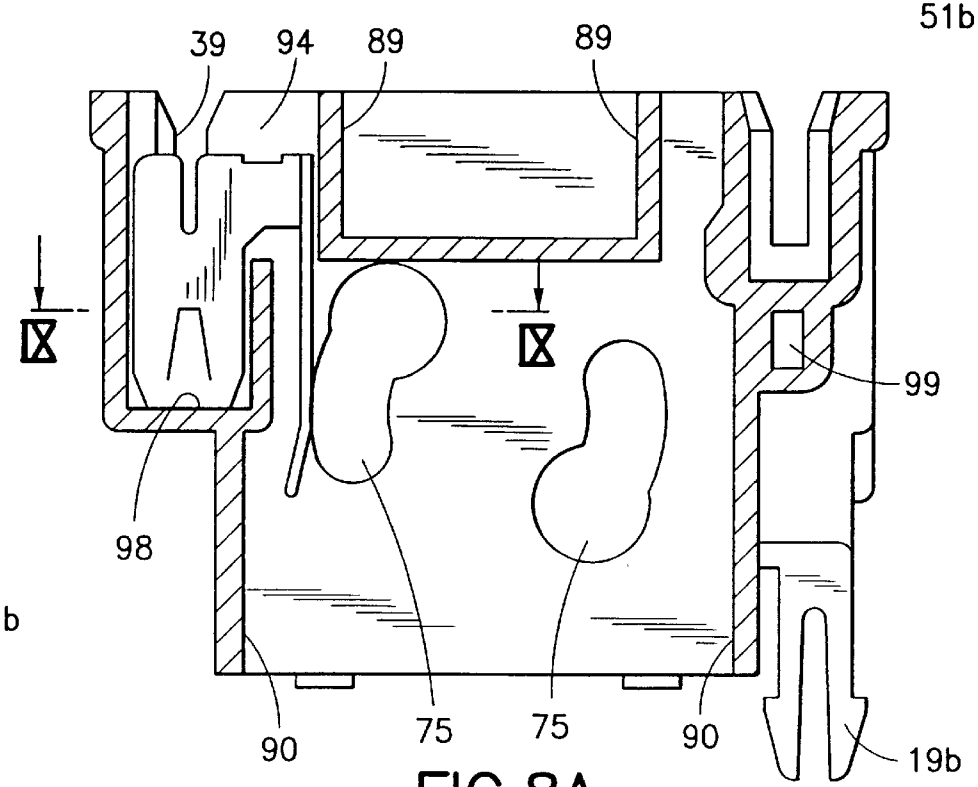
FIG. 8A shows the socket of FIG. 6, cut along a broken or offset section line VIII—VIII of FIG. 9.
Figure 8B:
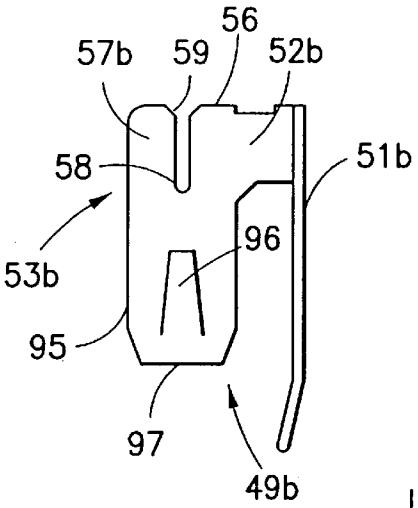
FIG. 8B is a plan view of the contact spring at the left side of FIG. 8A, removed from the socket.
Figure 8C:
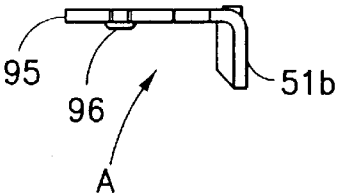
FIG. 8C is an end view of the contact terminal of FIG. 8B.
Figure 9:
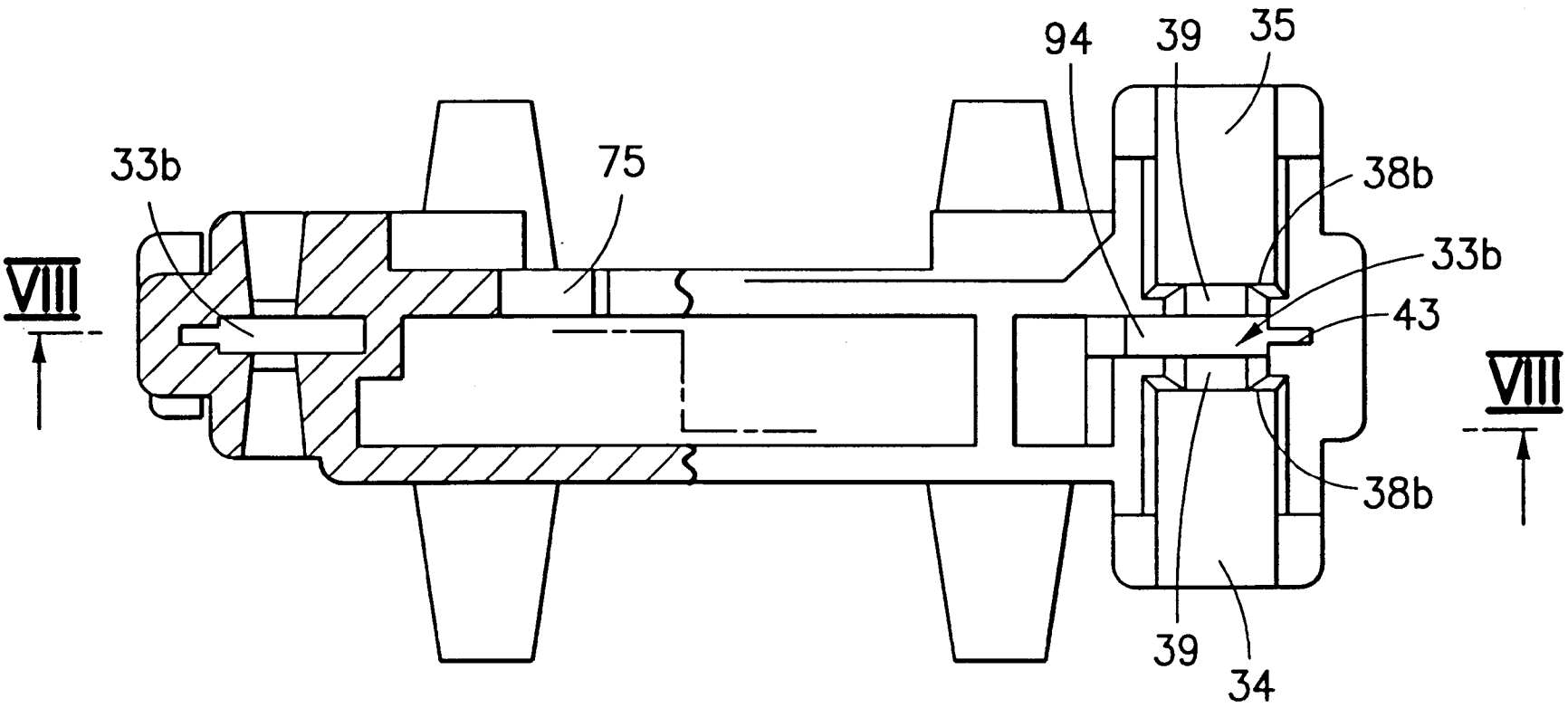
FIG. 9 is a top view of the socket of FIG. 6, partly in section, and where sectioned, along the section line IX—IX of FIG. 8.

Assembly of socket 1*b*:

The housing 2*b* is a unitary single plastic injection-molded element, into which the SBIP connectors 58*b* can be readily inserted, by pushing them into the respective chamber 33*b*. The lower portion of each chamber 33*b* is pocket-shaped and receives the extension 95 (FIGS. 8B, 8D). The lower edge 97 of the respective extension 95 engages on a bottom 98 of the chamber 33 (FIG. 8A). In this position, the punched-out tongue 96 engages in a suitable opening 99 formed in the vicinity of the bottom (FIG. 8A) of the respective pocket. After the terminal element 58*b* has been inserted, it can no longer be pulled out because the tongue 96 has an upwardly extending edge.

Upon insertion of an engagement wire, insertion pressure which results when a wire W is inserted into the insulation piercing slit 58 of the SBIP connector 53*b*, is transferred directly to the bottom part 98 of the housing 2.

Figure 11:
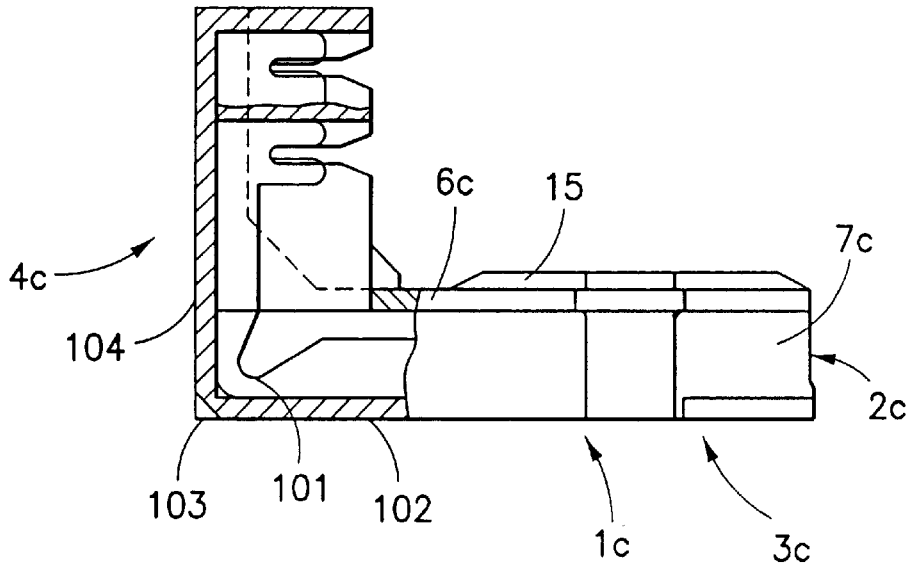
FIG. 11 is the socket of FIG. 10, hinged about a fold line.
Figure 10:
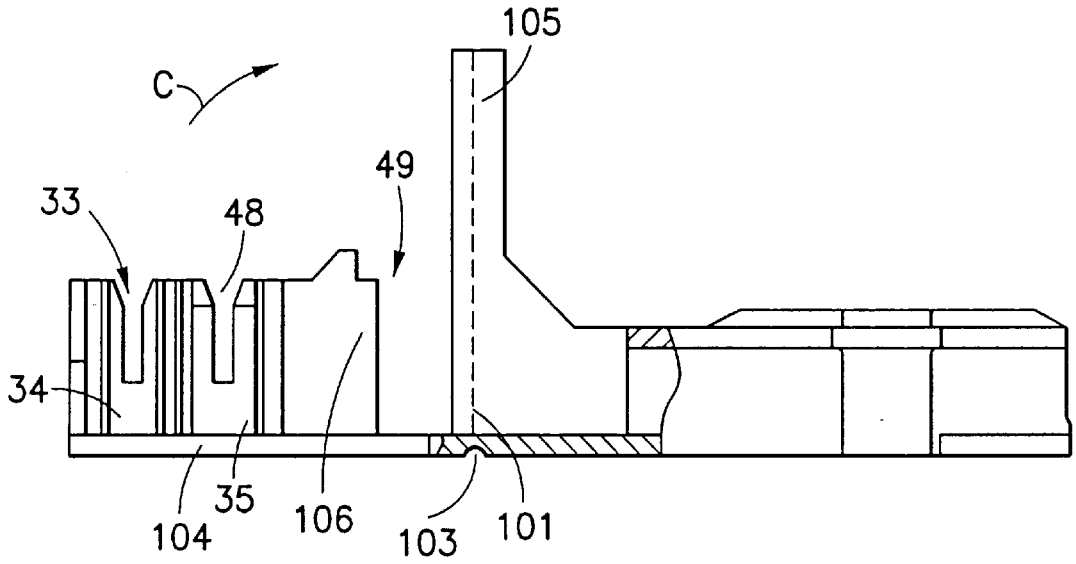
FIG. 10 is a side view, partly in section, of a socket similar to FIG. 1 and illustrating another arrangement.

FIG. 10 (collectively) and FIG. 11 illustrate an arrangement in which the socket 1*c* has a housing which is a unitary element, formed with a living hinge 103. The contact spring 49*c* has a preformed bend portion 101.

The socket 1*c* has a housing 2*c* which, looked at from the side, is essentially L-shaped, formed by two unitary housing legs 3*c*, 4*c*. The first housing leg 3*c* has a side wall 7 on which a back wall 102 is unitarily formed. The front wall 6*c*, with the rotary element 15, however, is formed as a snap-on cover.

The back wall 102, at the end removed from the rotary element 15, continues to form the living hinge 103, and then continues into a bottom portion 104 of the second housing leg 4*c*. The bottom portion 104 is essentially plate-like and, in finally assembled position, extends between two lateral bottom strips 105 of the second housing leg 4*c*. The central foldable bottom portion 104 has a wall structure which is similar to the structure described in connection with FIG. 1 for the housing leg 4. Between the walls, the axial length of which is limited to the space between the two bottom strips 104, chambers 33 and 48 are formed. The chambers 33, 48 are offset with respect to each other in a direction perpendicular to the plane of FIGS. 10 and 11, respectively.

Grooved strips 106 extend from the chambers 33 and 48 at the position where the slit 44 is formed. The strips 106 are unitary with the bottom portion 104, and extend upwardly therefrom. The grooved strips are between the strips 106 which, as best seen in FIG. 10, are formed as small wall portions or plate portions. Their function is similar to that of separating walls 28, FIGS. 1–3.

Figure 10A:
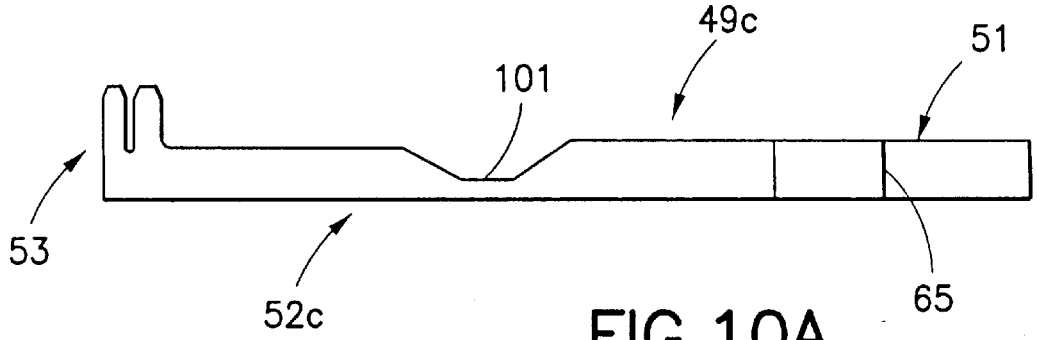
Fig. 10A illustrates a spring element of the socket of FIG. 10.

The contact spring 49*c* is shown in plan view in FIG. 10A; it has the contact terminal end portion 51 and the SBIP connector portion 53. The connecting portion 52*c*, however, is different in that at a suitable point between the contact terminal end portion 51 and the SBIP connector portion 53, the contact spring 49*c* is formed with a defined bend position or bend strip 101, formed by substantially reducing the width of the contact spring 49*c*. Basically, the two contact springs used in the embodiment of FIG. 10 are similar; the only difference is the spacing of the SBIP connector 53 from the bend portion 101.

Manufacture and final assembly, embodiment of FIGS. 10 and 11:

The housing 2*c* of the socket 1*c* is formed of a thermoplastic material, as a unitary injection-molded element. The cover 6*c* is a separate element. When injection-molded, housing 2*c* is molded in the position shown in FIG. 10, that is, with the two bottom strips 105 of the second housing leg 4*c* extending upwardly at right angles from the back wall 102. The bottom portion 104, between the lateral bottom strips 105, is flat and forms an extension of the back wall 102; in other words, the living hinge 103 is flat and stretched. The respective contact springs 49*c* are then inserted into the respective chambers, such that a forward contact spring 49*c* with the SBIP connector 53 is in a forward chamber 33, and the rearward contact spring, with a similar connector but somewhat closer to the bend portion 101, is in the rearward chamber 48. The two chambers have different spacing from the hinge 103, that is, they are staggered as already explained in connection with the embodiment of FIGS. 1–3. After insertion of the contact springs 49*c*, the central bottom portion 104, together with the contact springs 49*c*, is rotated, as shown in FIG. 10 by the arrow C, that is, in clockwise direction with respect to FIG. 10, until the bottom portion 104 is flush between the bottom strips 105. During this bending, the contact springs 49 are bent at the bend points 101 about an axis which is perpendicular through a plane defined by the flat side of the SBIP connectors, that is, the sheet-metal connectors are bent over their edge at the narrow side thereof.

The central portion 104 is snapped together with the end strips 105 by suitable projection-and-recess connections or snap-in arrangements, not shown, and which may be of any suitable construction.

Insertion of the SBIP connectors into the respective chambers, and subsequent pressing-in of wires into the SBIP connector slits is simple. The wire receiving grooves, forming extensions of the chambers, have openings for insertion of the wires. The insertion of the SBIP connector portions of the contact springs or strips 49 likewise is simple by forming openings in alignment with the respective chambers to permit ready insertion of the SBIP connector blades. Upon pressing an insulated wire into the SBIP connector, so that the conductor will be securely retained in the slit 58 of the connector likewise is simple, since the SBIP connector 53 is supported at its bottom within the housing. This support is not overstressed or damaged when the cutting force to cut the insulation of the conductor is overcome upon insertion of the conductor. Rather, it is readily possible to make the bottom, or the back side of the chamber, respectively, sturdy and unitary with the second leg 4 of the socket which, then, forms the bottom plate, from which ribs extend which, between themselves, define the recesses in which the connectors are placed on the one hand and the wire can be placed, on the other. This arrangement results in force distribution so that no forces will result which have the tendency to pull the SBIP connector out of the chamber, counter the direction in which it was inserted.

Damage to insulation of a wire within the groove which is closest to the front wall is reliably excluded by suitably locating the connecting element or portion 61, 52 of the contact spring or element such that the upper edge of the contact spring is clearly lower than the base of the wire insertion slit 58, at least in the region where the contact spring 49 intersects a groove carrying another conductor.

Insertion of the contact spring 49 into the housing of the socket is substantially simplified by so shaping the bottom regions of the grooves as well as of the chambers so that they smoothly merge with suitable insertion openings, avoiding any sharp edges on which the contact spring arrangement could catch upon insertion. Placing small ribs 28' on the sides of the grooves remote therefrom adjacent the openings and forming converging guide grooves directing the contact spring towards the chamber 33, 48, respectively, additionally assists in easy of insertion.

The bottom cover 8 (FIGS. 1, 2) of the housing part 3 may, of course, extend all the way to the bottom part 16, and indeed be unitary therewith, snapped for example on the housing portion 3 after assembly of the contact springs 49. This is not a requirement, however, and material can be saved by constructing the housing, as described in connection with FIGS. 1–3, by not forming a common cover over the entire back and bottom side. Protection against inadvertent contact with the contact spring arrangement can be easily achieved also with an uncovered structure by making the side walls 12 as well as the separating 28 sufficiently large so that the contact spring arrangements clearly are received within the side walls and separating spring arrangements.

The basic construction described in connection with FIGS. 1–3 can be readily expanded to also receive a starter by forming the housing leg 3 with a lateral extension, see FIGS. 4 and 5. This, then, permits constructing the contact spring arrangement in such a way that the supply conductors can be connected, as customary, to the SBIP connectors, and one of the contact springs is bent in the shape of the contact springs 49*a*, FIGS. 4, 5, so that the contact spring arrangement can also engage a base pin from a starter. The starter can also be retained in a separate structure connected by individual wires, each of which is coupled to an SBIP connector. In this arrangement, see FIGS. 6–9, the housing is somewhat box-like or block-like, and the SBIP connectors are located in the region of the side of the box-like structure.

The contact spring arrangement is preferably a punched sheet-metal element; by constructing it with a bend portion 101, FIG. 10A, it can be bent about an axis at right angles to the flat side of the sheet-metal element. This arrangement is suitable if the bottom region of the leg 4*c* of the housing is unitary with the bottom wall of the other leg 3*c*, and connected thereto by a living hinge 103. This arrangement permits insertion of the contact springs when it is longitudinally stretched, which permits easy placement in the respective chambers, and then bending the bottom portion 4*c* together with the already assembled contact springs 49*c*, as shown schematically by the arrow C in FIG. 10.

The socket can be readily constructed to receive single-pin instant start fluorescent lamps, in which case only a single chamber similar to chambers 33 or 48 need be provided, and the slit blade insulation piercing connector 53 then shaped to fit into the single chamber, with the contact terminal end portion suitably shaped to make contact with the single terminal pin of the single-pin fluorescent lamp.

Figure 12:
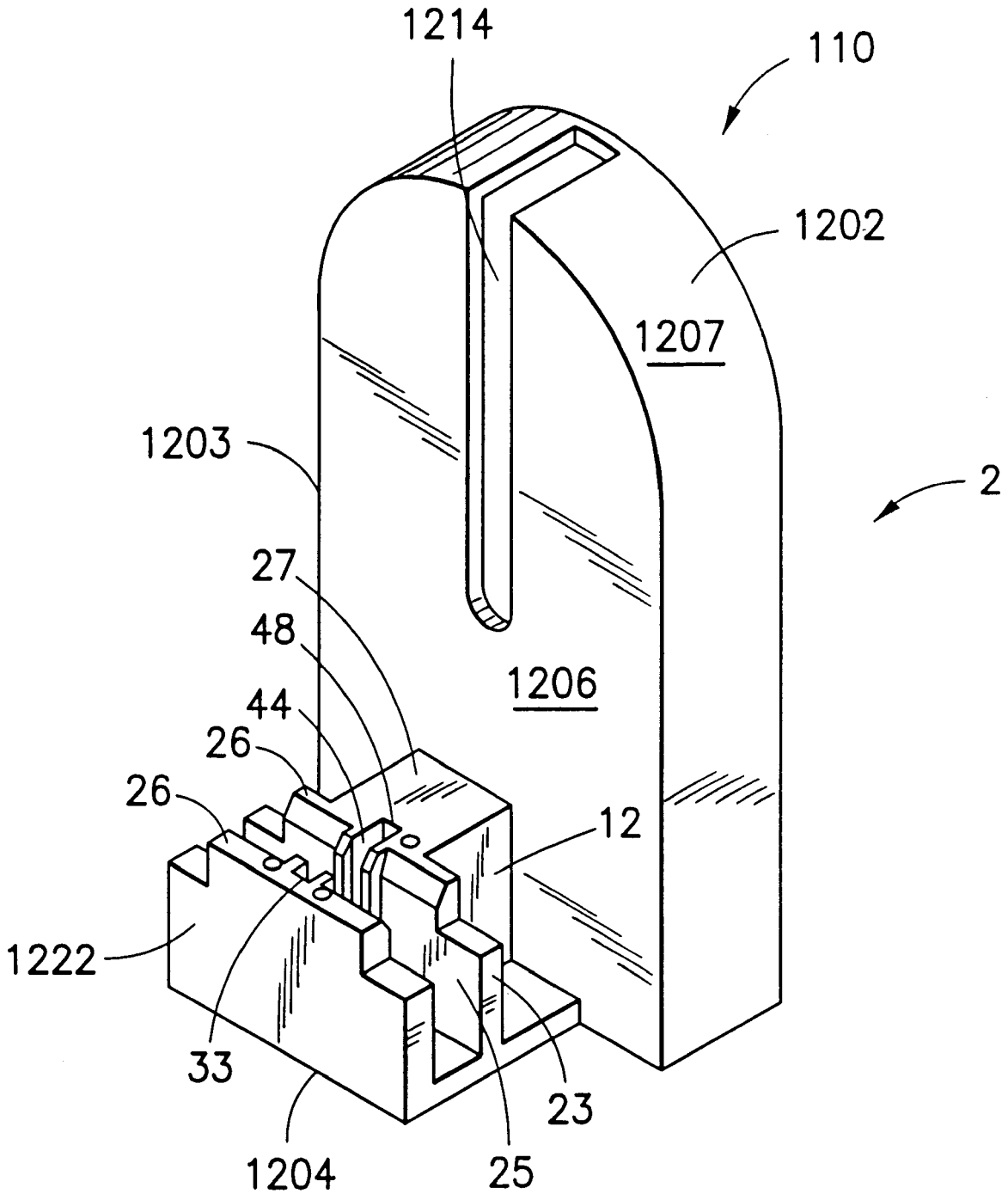
FIG. 12 is a view similar to FIG. 1 of a socket for a double-based, single-pin fluorescent lamp.
Figure 13:
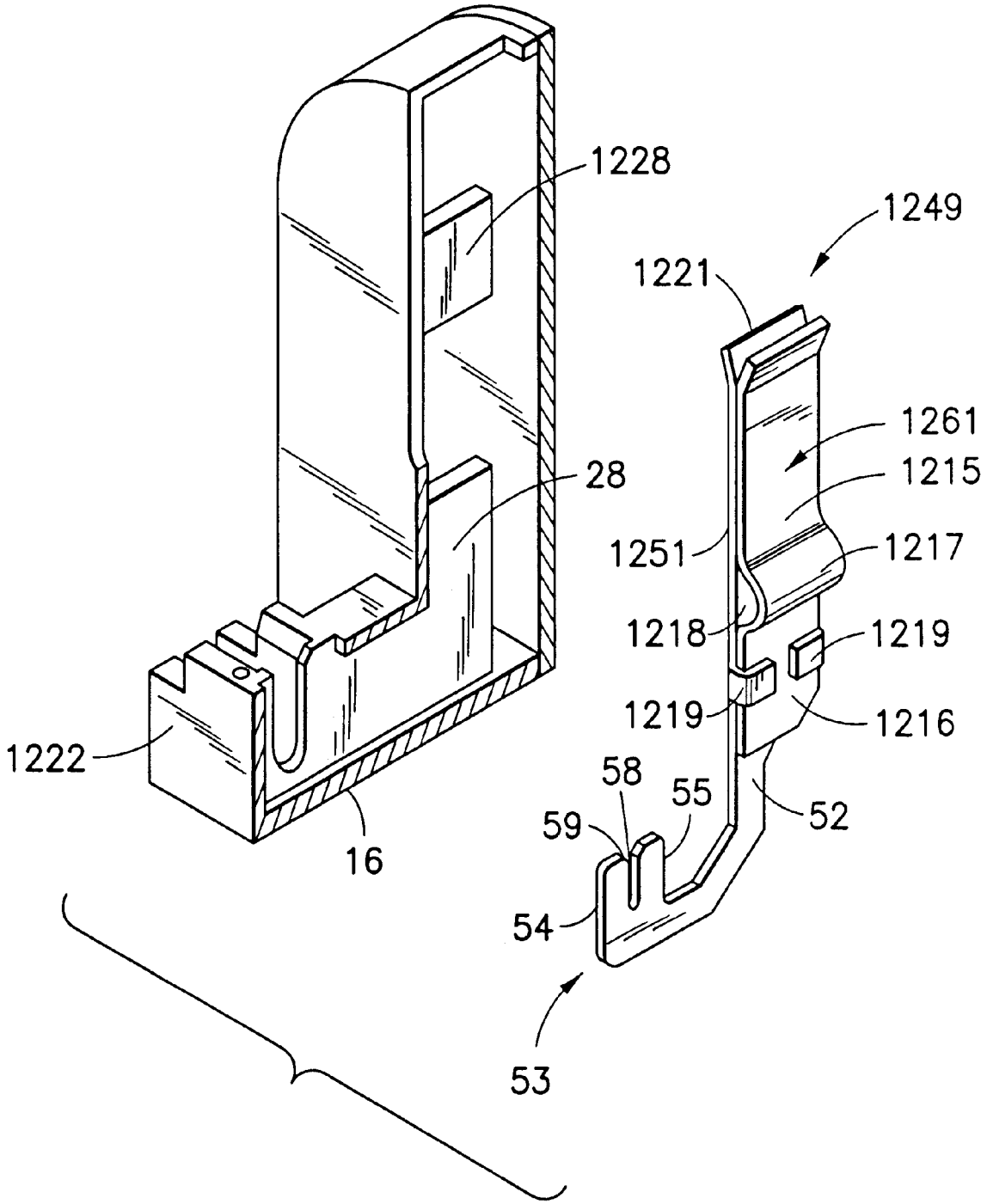
FIG. 13 is a partially sectioned and exploded view of the socket of FIG. 12.

FIGS. 12 and 13 illustrate a socket for single-pin fluorescent lamps.

The socket 110 is designed to receive only a single base pin from a double-based, single-pin fluorescent lamp, for example of the "rapid-start" type. The same reference numerals have been used for those parts of the socket which are identical, and incremented by 1200 for parts which are similar.

The housing 1202 is generally L-shaped and has an upstanding first leg 1203 and a second, essentially horizontal extending leg 1204. The housing leg 1203 has a front wall 1206 which is formed with a single narrow elongated slot

1204, in order to receive the base pin of the respective fluorescent lamp. To permit ready insertion of a such a base pin in the slot 1204, slot 1204 is open at the top of the side wall 1207, see Fig. 12.

The horizontal leg 1204 differs from the leg 4 of FIG. 1 in that it has only a single groove 25. The groove 24 is not needed. Thus, wall 1222 is at the same time the end wall remote from the upper leg 1203 of the lower leg 1204. The groove 25 and the chamber 48 therein are identical to the groove and chamber described in connection with FIGS. 1–3.

A single contact spring 1249 is retained in the housing 1202, for insertion into the chamber 48. The contact spring arrangement 1249 is similar to the contact spring 49, FIG. 2. The function and general construction is clearly described in connection with spring 49, FIGS. 1–3.

The contact spring 1249 differs, however, in that the portion 51 is elongated, as seen at 1251, and a second contact spring element 1261 is secured thereto. The two spring elements 1251 and 1261 partly engage with flat surfaces against each other; they are, respectively, shaped to receive a terminal pin of the lamp with which the socket is intended to be used. The element 1261 has an upper straight section 1215 and a lower straight section 1216; between the two straight sections, a wave-shaped, outwardly bulged section 1217 is formed, defining a hollow, generally tubular space 1218 for the terminal pin of the lamp so that the pin is largely surrounded and clamped by springs 1249 and 1261.

The spring element 1261 is secured to the structure 1249 by two bent-over tabs 1219 which are formed on the spring unit 1249 and bent over the auxiliary spring element 1261. Other ways of attachment may be used, as is suitable. Preferably, the tabs 1219 are unitary with the spring 1249.

The upper ends of the springs 1249 and 1261 are outwardly bent, to form a funnel-like insertion opening 1221. This opening, in the assembled position, will be below the top portion of the slit 1214.

When assembled, the spring element 1249 is within the housing 1202, and so positioned that the slot 1214 is in alignment with the spring elements 1249, 1261. In this position, the lower portion of the contact spring 1249 passes between respectively opposite separating walls 28; the slit blade insulation piercing (SBIP) connector portion 53 will be located in the chamber 48.

In all other respects, the structure can be identical to that described in connection with FIG. 1. If desired, a further auxiliary back-up wall 1228 can be formed in the upper part of the housing, to provide a back-up for the spring elements 1249, 1261.

Some features of mere engineering, for example connection of parts by snap-together technology, and customary and well known with regard to plastic structures, have been omitted from the drawing and from a detailed description, since their application is well known in the technology of connecting plastic parts.

Various changes and modifications may be made, and any features described herein in connection with any one of the embodiments may be used with any of the others within the scope of the inventive concept.

We claim:

1. A socket (1) for an electrical device having at least one projecting terminal, the socket being adapted for connection to at least one insulated electrical supply wire (W) including an internal electrical conductor, said electrical device including fluorescent lamp, starter therefor, or elongated tubular lamp, said socket comprising:

a socket housing (2) of insulating material;

at least one contact element (49) of electrically conductive material forming a single unitary element and comprising:

a contact terminal portion (51) adapted for engagement with a projecting terminal of the electrical device located in the housing, a slit blade insulation piercing connector portion (53) including a blade part (57) formed with a conductor insertion slit (58), said slit cutting the at least one insulated electrical supply wire and forming an interference fit with the conductor of the wire, and a connecting portion (52) connecting said slit blade insulation piercing connector portion (53) with the contact terminal portion (51);

said socket housing being formed with a terminal reception chamber (33, 48), open at a top of said chamber, said chamber being defined by a chamber bottom (38') and by spaced parallel chamber side walls (38), wherein at least one of said chamber side walls (38) is formed with blade receiving means (43) for receiving the blade part (57) of the slit blade insulation piercing connector portion (53) of the contact element, said chamber bottom (38') forming an abutment or stop for said blade part (57) of the contact element, wherein said parallel side walls including wire retention slits (39) directed towards the conductor insertion slit (58) of the slit blade insulation piercing connector portion (53); and said socket housing further being formed with two groove-like recesses (34, 35) forming wire receiving grooves (24, 25) open at the top, said wire receiving grooves (24, 25) being located immediately adjoining the respective one of said side walls of said chamber (33, 48), said wire receiving grooves (24, 25) further, at a side of said slits which is remote from said blade receiving means (43, 43') extending longitudinally away from the wire retention slits (39, 39'); and said wire receiving grooves (24, 25) being wider than the wire retention slits (39, 39') and being dimensioned and shaped for reception of an end portion of the insulated wire projecting from the slit blade insulation piercing connector portion (53) and for protection of a cut end of the internal conductor with respect to accidental contact thereof, wherein the recesses (34, 35) are deeper than the conductor insertion slits (58) of the slit blade insulation piercing connector portion (53).

2. The socket of claim 1, wherein said insulation piercing slit (58) has sharp edges.

3. The socket of claim 1, wherein said insulation piercing slit (58) has funnel-shaped free ends (59).

4. The socket of claim 1, wherein said insertion slit (39) has funnel-shaped free end portions.

5. The socket of claim 1, further including socket attachment means (18, 19) unitarily formed on said housing.

6. The socket of claim 1, wherein said housing (2) is generally L-shaped, and defines first and second housing legs (3, 4) unitarily connected together and having longitudinal axes, the longitudinal axes of the housing legs (3, 4) being substantially at right angles with respect to each other.

7. The socket of claim 6, wherein one (3) of the housing legs has a front wall (6) formed with at least one opening to receive at least one connecting terminal of the electrical device.

8. The socket of claim 7, further including a rotary element (15) rotationally received in said front wall (6), said rotary element and being shaped and dimensioned to receive a two-pin base of a two-pin double-based fluorescent lamp.

9. The socket of claim 6, wherein the second housing leg (4) is formed with at least one chamber (33, 48); and wherein the slit blade insulation piercing connector portion of the at least one contact element is located in said chamber.

10. The socket of claim 6, wherein the second housing leg (4) is formed with two chambers (33, 48), each chamber retaining the slit blade insulation piercing connector portion (53) of a respective contact element (49);

said groove-like recesses (34, 35) extend with their respective longitudinal axes at right angles with respect to a longitudinal axis of the second leg (4) of the housing;

said wire receiving grooves (24, 25) being spaced from each other and being intersected by said respective chambers; and wherein the two chambers (33, 48) and the respective groove-like recesses (24, 35) terminating thereat are longitudinally, with respect to the longitudinal extent of the grooves (24, 25), relative to each other.

11. The socket of claim 10, wherein that one of the grooves (25) adjacent the front wall of the first (3) leg of the housing is formed with openings (44, 47) in side walls (36, 37) defining the grooves (25), which openings (44, 47) are in alignment with the chamber (33) in the other groove to permit insertion of the slit blade insulation piercing connector portion (53) in the chamber (33) in the other groove, in an insertion direction extending from the first leg (3) towards the second leg (4) of the housing (2).

12. The socket of claim 11, wherein said openings (47) have a width which corresponds at least approximately to the thickness of the slit blade insulation piercing connector portion (53) to be inserted therein.

13. The socket of claim 11, wherein the chamber (33) and the immediately adjacent groove (25) is formed with bottom surfaces having equal level; and wherein the openings (44, 47) merge smoothly with the bottom.

14. The socket of claim 11, wherein the second housing leg (4) is formed with a bottom (16) which, in the region between the front wall (6) of the first housing leg (3) and the closest groove (25) thereto, merges smoothly with the bottom of the adjacent groove (24) and the chamber (33) into which said adjacent groove (24) merges.

15. The socket of claim 9, wherein that one of the chambers (48) in the groove (25) closest to the front wall (6) of the first leg (3) is formed with an opening (47) extending towards said first housing leg (3) to permit insertion of the slit blade insulation piercing portion (53) into said chamber.

16. The socket of claim 15, wherein said groove (25) is formed with a smooth bottom (16) which merges smoothly with the groove (25) and the chamber (48).

17. The socket of claim 11, further including a plurality of separating walls (28, 106) extending in the second leg (4) of the housing and into the first leg (3) of the housing at a side remote from the front side (6) of the first leg of the housing, said separating walls being located between the openings (44, 47) in the side walls (36, 37) of the grooves (24, 25); and wherein said housing has side walls (12), the side walls and separating walls defining individual reception spaces for the contact springs (49).

18. The socket of claim 9, wherein a groove (24, 25) intersects said at least one chamber (33, 48), and an opening (44, 47) is formed in a side wall defining the chamber, and aligned with the respective chamber; and wherein at least one separating wall (28) is located on the back side of the first leg (3) of the housing (2) and extends towards and up to said opening, said separating wall, together with at least one side wall (12) of the housing, providing electrical contact protection with respect to the contact element (49) inserted in said chamber.

19. The socket of claim 17, wherein at least one of: the side wall region (12) and the separating wall (28) is formed with guide ribs leading to said at least one opening to direct insertion movement of the contact element (49).

20. The socket of claim 1, wherein the housing (2, 2*a*, 2*c*) includes attachment means (17, 18, 19) formed on the housing; and wherein said insertion slit (39) has a direction which extends away from said attachment means.

21. The socket of claim 1, wherein said unitary contact element (49, 49*a*, 77, 49*b*, 49*c*) comprises a punched sheet-metal element.

22. The socket of claim 1, wherein said contact element (49) is essentially L-shaped, wherein the slit blade insulation piercing connector portion (53) forms one end portion of the L-shaped contact element, and at least one of the connection element portion (52) and the contact terminal end portion (51) forms another end portion of the L-shaped contact element.

23. The socket of claim 1, wherein the conductor insertion slit (58) of the slit blade insulation piercing connector portion (53) defines a longitudinal direction, which direction is the same as that of the contact terminal end portion (51).

24. The socket of claim 1, wherein the connecting element (52) includes two leg parts (61, 62) which extend at a right angle with respect to each other; and a connecting part (63) is provided connecting the two leg parts, which is inclined with respect to each of said leg parts (61, 62).

25. The socket of claim 24, further including a projecting part (64) located within the angle formed by said leg parts (61, 62) and projecting from said connecting part (63), said projecting part having an upper shoulder surface (67) which is at a level above the opening of the conductor insertion slit (58) in the blade part (57) of the slit blade insulation piercing portion (53).

26. The socket of claim 1, wherein the contact terminal end portion (51) and the slit blade insulation piercing connector portion (53) are located in essentially the same plane.

27. The socket of claim 10, wherein one of the contact element (49) which intersects one of the recesses (25) has an upper edge of its connecting element portion (52) which is below the lower end of the conductor insertion slit (58) of the slit blade insulation piercing connector portion (53) of that contact element (49) which is inserted in the chamber (48) from which said groove (25), which is being intersected, extends.

28. The socket of claim 1, wherein said wire receiving grooves are extended transversely with respect to the wire retention slits.

* * * * *